US005584653A

United States Patent [19]

Frank et al.

[11] Patent Number: 5,584,653

[45] Date of Patent: Dec. 17, 1996

[54] DEVICE FOR REDUCING THE GENERATION OF NOISE IN FANS

[75] Inventors: Erich Frank, Hochdorf; Fritz Mohring, Ostfildern, both of Germany

[73] Assignee: J. Eberspächer, Esslingen, Germany

[21] Appl. No.: 548,294

[22] Filed: Nov. 1, 1995

Related U.S. Application Data

[63] Continuation-in-part of Ser. No. 118,126, Sep. 8, 1993, abandoned.

[30] Foreign Application Priority Data

Sep. 8, 1992 [DE] Germany ..... 42 30 014.2

[51] Int. Cl.[6] ..... F04D 29/66

[52] U.S. Cl. ..... 415/119; 415/55.4

[58] Field of Search ..... 415/55.1, 55.2, 415/55.4, 119

[56] References Cited

U.S. PATENT DOCUMENTS

| | | | |
|---|---|---|---|
| 2,245,094 | 6/1941 | Neibert | 415/55.4 |
| 3,442,077 | 5/1969 | Youhouse | 415/119 |
| 3,989,411 | 11/1976 | Middleton | 415/55.4 |
| 4,306,833 | 12/1981 | Sixsmith et al. | 415/55.4 |
| 4,412,781 | 11/1983 | Abe et al. | 415/55.4 |
| 5,120,193 | 6/1992 | Kadle et al. | 415/119 |
| 5,205,707 | 4/1993 | Smith et al. | 415/55.4 |

FOREIGN PATENT DOCUMENTS

| | | | |
|---|---|---|---|
| 0165795 | 12/1981 | Japan | 415/55.4 |
| 0080092 | 4/1988 | Japan | 415/55.4 |
| 0234590 | 8/1992 | Japan | 415/55.2 |

*Primary Examiner*—Edward K. Look
*Assistant Examiner*—Mark Sgantzos
*Attorney, Agent, or Firm*—McGlew and Tuttle

[57] ABSTRACT

A device for reducing the generation of noise in a fan (11) having a gas intake channel (13), a gas discharge channel (14) and a gas propulsion device (15), in particular a side channel fan for supplying combustion air in a heater. At least in the regions of the opening cross-section (18, 19) of the gas intake channel (13) and/or the gas discharge channel (14) there is disposed structure for inducing a flow resistance (interference structure 20, 21).

7 Claims, 2 Drawing Sheets

DEVICE FOR REDUCING THE GENERATION OF NOISE IN FANS

This is a continuation-in-part application of application Ser. No. 08/118,126 filed Sep. 8, 1993.

FIELD OF THE INVENTION

The invention relates to a device for reducing the generation of noise in a fan having a gas intake channel, a gas discharge channel and a gas propulsion means, in particular a side channel fan for supplying combustion air in a heater.

BACKGROUND OF THE INVENTION

The generation of noise in heaters provided with a fan for supplying combustion air to the combustion chamber of the heater is decisively determined by the flow noise caused by the combustion air flow in the fan. In particular with small heaters, as used for example as engine-independent additional heating means in motor vehicles, this generation of noise turns out to be inconvenient because the additional heating means is located in the vicinity of the vehicle passengers due to the as a rule restricted vehicle dimensions.

SUMMARY AND OBJECTS OF THE INVENTION

It is thus the object of the invention to provide a device enabling operation of a fan with reduced generation of noise.

According to the invention, a device for reducing the generation of noise in a fan is provided having a gas intake channel, a gas discharge channel and a gas propulsion means preferably in the form of a side channel fan for supplying combustion air in a heater. At least in the region of an opening cross-section of the gas intake channel and/or the gas discharge channel there is disposed interference means for inducing a flow resistance. The interference means induces flow turbulence at least in the region of the opening cross-section of one of the gas intake channel and the gas discharge channel. The gas flow interference means includes a plurality of interference elements, at least one of said interference elements being irregular, namely different in size, shape or spacing relative to the other interference elements.

The shape, and/or size of the interference elements are different and/or the plurality of interference elements includes a first interference element positioned adjacent to a second interference element with a spacing between the first interference element and the second interference element and an additional interference element is provided spaced a distance from the second interference element wherein the distance between said second interference element and said additional interference element is different from the distance between said first interference element and said second interference element.

The interference means influences the flow behavior of the gas flow accelerated by the gas propulsion means. Due to the acceleration of the gas flow, pressure waves are generated in the fan, in particular in the region of the opening cross-section of the gas discharge channel and the gas intake channel, with the propagation of said pressure waves resulting in the known disadvantageous noise generation in the fan. The interference means induces flow resistances in the accelerated gas flow, having an impeding effect on the pressure wave propagation. This prevents the generation of large pressure waves which otherwise lead to a corresponding increase of the noise level during operation of the fan. Instead, smaller pressure waves are produced which, when propagating in the fan housing, result in a correspondingly reduced noise generation. The interference means with the irregularity, as noted above, further reduces the noise situation. By providing the "irregularity" (as regards distance between interference elements, size of interference elements, shape of interference elements) substantial improvements over prior art interference elements are achieved. It is believed that interference elements without any irregularity of the pattern (as they had been provided by the prior art) result in the formation of additional waves; the regularity of the pattern in terms of distance, size and shape allows the formation of waves the wavelength of which depends upon the distance and size of the interference elements. With the design of the invention, however, regularity is reduced or avoided. There is less cause for the generation of extra waves, but more structure, namely the interference structure, with the irregular interference elements, for the extinction of waves by interference. The fan according to the invention becomes less noisy. Consequently, the generation of noise during fan operation is reduced significantly by the interference means according to the invention.

In a fan designed as a side channel fan it turns out to be particularly advantageous when the interference means with irregular interference elements is disposed in a marginal portion adjacent the gas discharge channel and/or the gas intake channel, which is part of a housing partition parallel to the plane of rotation of the gas propulsion means. Side channel fans consist of at least two housing parts between which is disposed a gas propulsion means, for example in the form of an impeller wheel. Both the gas intake through the gas intake channel and the gas discharge through the gas discharge channel take place on one side of the impeller wheel, with the gas flowing in a channel extending parallel to the plane of rotation of the gas propulsion means. The arrangement of the interference means in the marginal portion of the housing partition turns out to be particularly effective for reducing the generation of noise, since the housing partition is located directly adjacent the gas propulsion means and thus the maximum gas speeds, induced by the gas propulsion means, occur in this region.

In an interference means consisting of several interference elements, the effect of the individual interference elements interfering with the accelerated gas flow and thus with the propagation of pressure waves can be enhanced by providing the irregularities as noted. The irregularities are with respect to the individual interference elements wherein they may be provided with different sizes and/or shapes. The same holds when the interference elements have different spacings from each other. In this way, the formation of interferences is achieved between the individual interference elements, which as such further increase the interfering effect of the individual interference elements.

In a fan designed as a side channel fan, the interference elements provided in the housing partition furthermore can be arranged such that they are of greater extension parallel to the housing partition than in the direction perpendicular thereto. This, too, renders possible a further improvement of the interfering effect.

The interference elements provided in the form of material recesses may consist of notches of approximately V-shaped cross-section. The notch-shaped design of the interference elements, which can be realized for example by file cuts applied to the fan housing after the casting operation, constitutes a particularly simple possibility of realizing interference elements. Interference elements formed by material recesses also offer the advantage that they can be produced already during the manufacture of the fan housing that is usually made by a casting operation, for example by introducing corresponding structural parts into the casting mold. The shape may be varied from one interference element to the next, to provide the irregularity. For example, there may be a mix of recesses of semicircular-shaped cross-section and V-shaped cross-section or even square cross section.

In the following, a preferred embodiment of the device according to the invention will be elucidated in more detail with reference to the drawings. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter.

DESCRIPTION OF THE PREFERRED EMBODIMENTS

Figure 1:
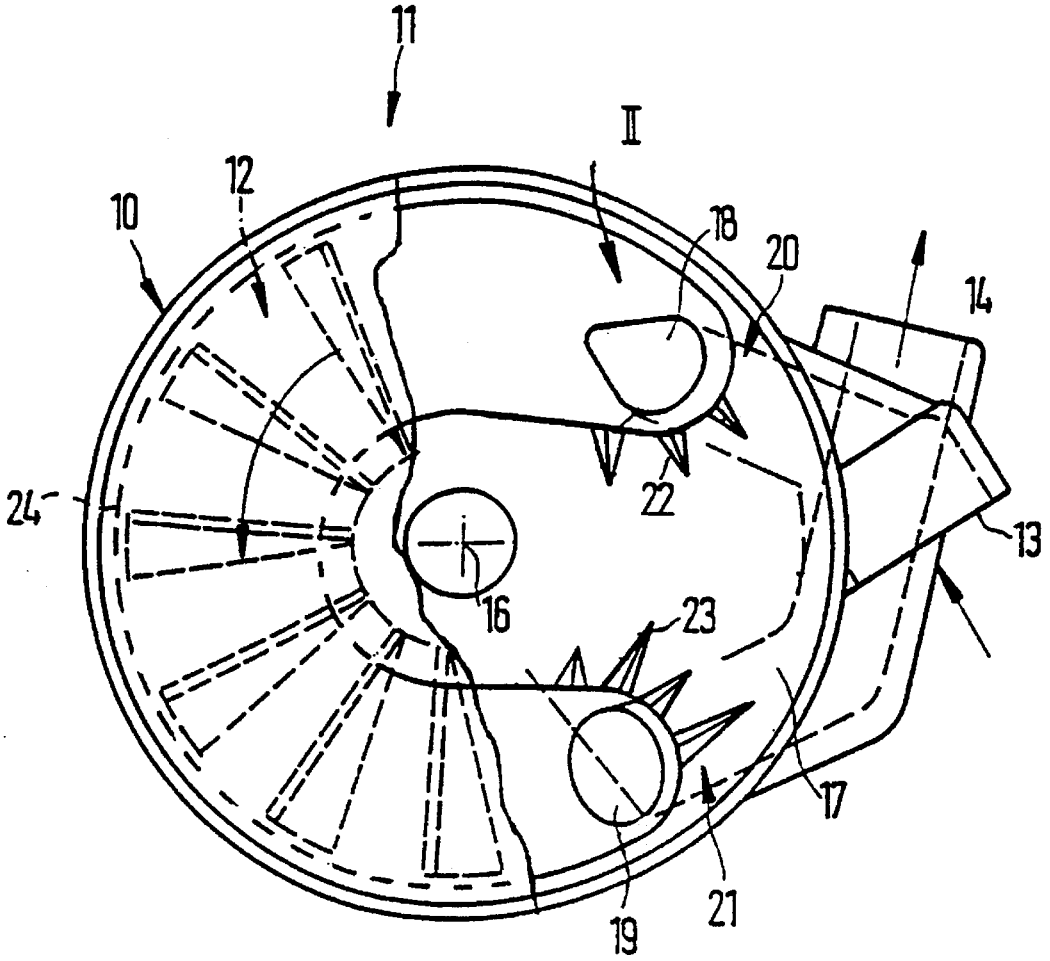
FIG. 1 is a top partially cutaway view of a housing part of a side channel fan having a side channel and, opening into the latter, a gas discharge channel and a gas intake channel with an interference means with irregular interference elements provided both in the region of the gas intake channel and in the region of the gas discharge channel.

Referring to the drawings in particular, FIG. 1 shows a housing part 10 of a side channel fan 11 having a side channel 12 formed therein, as well as a gas intake channel 13 and a gas discharge channel 14.

FIG. 1 shows in dashed line an impeller wheel 15 rotatably mounted on a rotary shaft 16 between the housing part 10 and a further housing part, not shown in FIG. 1, constituting together with housing part 10 the fan housing. The impeller wheel 15 serves as gas propulsion means by means of which gas sucked in through the gas intake channel 13 is accelerated in the side channel 12 and discharged through the gas discharge channel 14. When using the side channel fan 11 for supplying combustion air to a combustion chamber of a heater not shown herein, the gas discharge channel 14 is connected to this heater or rather the combustion chamber of this heater. A suction line, not shown, may be connected to the gas intake channel 13.

A partition 17 of the housing part 10, disposed immediately adjacent the impeller wheel 15 and parallel to the latter, is provided in is marginal portions adjacent the opening cross-sections 18, 19 of gas intake channel 13 and gas discharge channel 14, respectively, with an interference means 20 and 21, respectively. The interference means 20, 21 shown in exemplary manner in FIG. 1 with respect to their arrangement and design each have individual interference elements 22, 23 each provided in the form of notches of V-shaped cross-section (FIG. 2). The interference elements 20, 21, although they are all V-shaped in cross-section, are irregular, to provide an enhanced noise reducing effect.

A side channel fan without an interference element creates noise when operated. It is assumed that the noise is mainly the result of air flow pulses created when the blades pass the partition either at the intake channel side or at the discharge channel side. Providing interference elements having all the same size and shape and distance therebetween (without an irregularity as noted herein), reduces the noise. It is assumed that the interference elements "interrupt" the air flow pulses; instead of one pulse where is a number of smaller/weaker pulses. The noise situation can be further improved by providing "irregularity" (as regards distance between interference elements, size of interference elements, shape of interference elements). It is believed that interference elements without any irregularity of the pattern (as they had been provided by the prior art) result in the formation of additional waves; the regularity of the pattern in terms of distance, size and shape allows the formation of waves the wavelength of which depends upon the distance and size of the interference elements. With the design of the invention, however, regularity is reduced or avoided. Accordingly with such irregularity there is less reason for the generation of extra waves, but more reason for the extinction of waves by interference. The fan becomes less noisy.

The interference elements 22, 23 are irregular as to spacing between the elements. A first interference element of the interference means 20 or 21 is positioned adjacent to a second interference element. The first interference element is spaced from said second interference element by a distance. An additional interference element is provided spaced a distance from said second interference element. The distance between said second interference element and said additional interference element is different from said distance between said first interference element and said second interference element. Additionally, the dimensions (length) of the interference elements which comprise the interference means 20 are all different. Likewise, the dimensions (length) of the interference elements which comprise the interference means 21 are all different.

FIG. 2 in view rotated by 90° from the representation of FIG. 1, illustrates the V-shaped cross-section of the interference elements 22, from which it can be seen that the largest cross-sectional dimension (depth) of the interference elements 22 is located in a plane perpendicular to the partition 17 and that the cross-sectional dimension continuously decreases as the interference elements 22 extend further into the partition 17, i.e. the notches end gradually.

In addition to the V-shaped design of the notch cross-section with varied length irregularity, the design of the notches in an inclined manner in partition 17 provides a further irregularity. This structure as well as the gradually ending manner (taper) therein produces a directional interference effect of the interference elements 22.

FIG. 1 shows the interference elements 22 and 23 of the interference means 20, 21 respectively, disposed in approximately radial manner around the opening cross-sections 18, 19 of the gas intake channel 13 and the gas discharge channel 14, respectively. It is just as well possible that the individual interference elements 22 and 34 of the interference means 20 and 21, respectively, are aligned substantially parallel to each other. In this case the irregularity of the elements is based on differences in dimension as well as different spacing between adjacent elements. Contrary to the illustration in FIG. 1, the interference elements 22 and 23, respectively, may of course also be of equal design as regards their size, in which case the irregularity is due only to a difference in spacing between the adjacent interference elements. Furthermore, it may turn out advantageous to arrange interference elements 22, 23 not only in the region of the opening cross-sections 18, 19 or in the region of one of these two opening cross-sections, but to provide interference elements 22, 23, in distributed manner across the entire marginal portion of the partition 17 from the opening cross-section 18 to the opening cross-section 19. Moreover, the interference elements 22, 23 need not necessarily be restricted to the region of the partition 17, but instead or in addition thereto may also be disposed directly on the opening cross-sections 18 and 19 of the gas intake channel 13 and the gas discharge channel 14, respectively, or also internally on the outer peripheral edge 24 of the side channel 12, for obtaining the advantageous effects rendered possible by the invention.

Figure 2A:
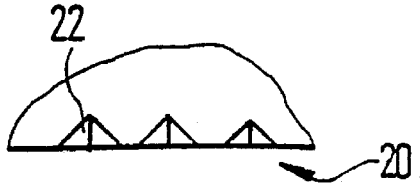
FIG. 2*a* is a side cutaway view of a housing section illustrating the interference means in the region of the gas intake channel corresponding to a view marked by arrow II in FIG. 1.
Figure 2B:
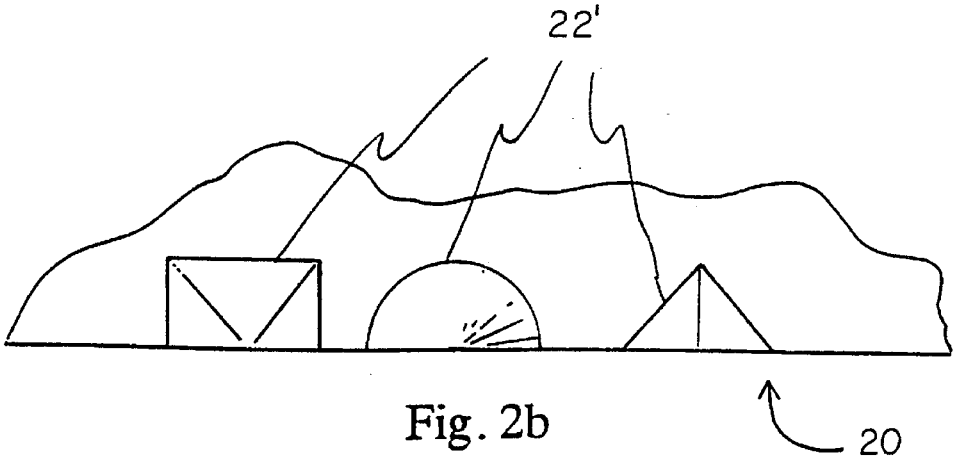
FIG. 2*b* is a side cutaway view of a housing section, similar to FIG. 2*a*, illustrating another interference means in the region of the gas intake channel.
Figure 2C:
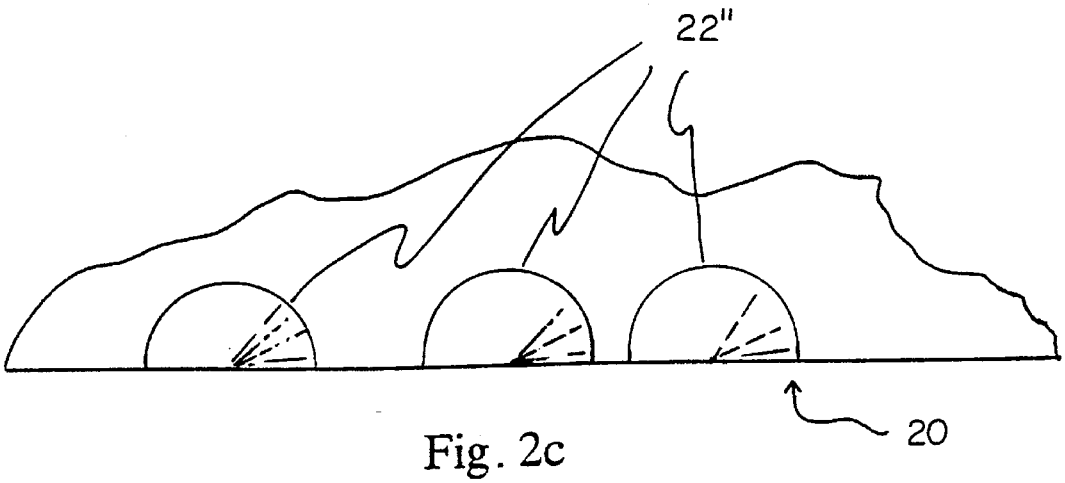
FIG. 2*c* is a side cutaway view of a housing section, similar to FIG. 2*a*, illustrating another interference means in the region of the gas intake channel.
Figure 2D:
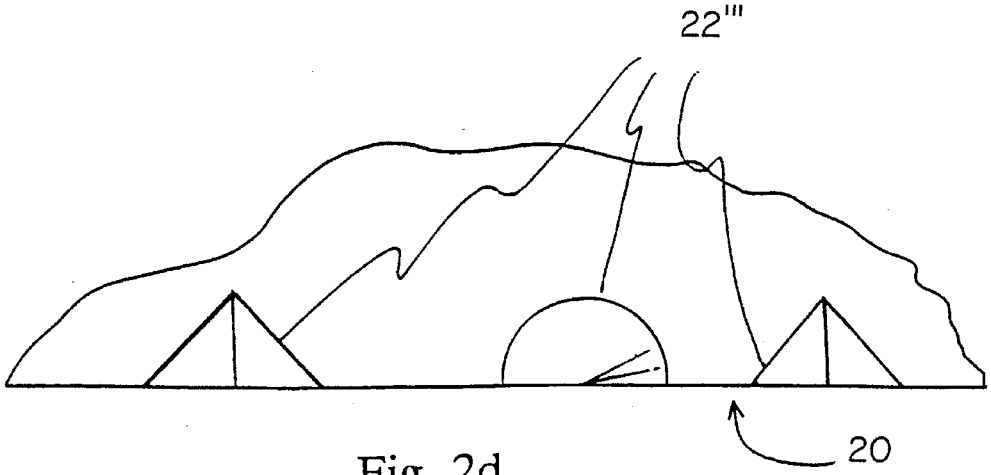
FIG. 2*d* is a side cutaway view of a housing section, similar to FIG. 2*a*, illustrating another interference means in the region of the gas intake channel.

FIGS. 2*b*, 2*c* and 2*d* illustrate other possibilities in providing an irregularity among the interference elements that comprise the interference means. Based on the use of any one irregularity factor, namely changing the dimension, changing the spacing between interference elements, changing the orientation as to adjacent elements and changing the shape of the interference elements, the noise may be lowered. Combinations of irregularities, as noted with the embodiment of FIG. 2*a*, can be combined.

The embodiment of FIG. 2*b* combines all the possible irregularity factors to achieve improved interference. The interference elements 22' each have a different dimension (length—extent into partition 17) as in the embodiment of FIG. 2*a*. Also the spacing between elements and the orientation of the elements is different, as in the embodiment of FIG. 2*a*. However, different shapes of the notches, square-shaped, v-shaped, semicircle-shaped are provided for the elements 22'. In the embodiment of FIG. 2*c* the interference elements 22" each have a different dimension (length—extent into partition 17) as in the embodiment Of FIG. 2*a* and the spacing between elements and the orientation of the elements is different, as in the embodiment of FIG. 2*a*. However, the elements 22" are semicircle-shaped. In FIG. 2*d* the interference elements 22''' each have a different dimension (length—extent into partition 17) as in the embodiment of FIG. 2*a* and the spacing between elements and the orientation of the elements is different, as in the embodiment of FIG. 2*a*. However, the outer interference elements 22''' are V-shaped whereas the inner interference element 22''' is semicircle-shaped.

In each of the embodiments of FIGS. 2*b*–2*d*, there is a taper to the interference element from the face of the partition going in the direction of the fan. The largest cross-sectional dimension (depth) of the interference elements 22', 22", 22''' is located in a plane perpendicular to the partition 17 and that the cross-sectional dimension continuously decreases as the interference elements 22', 22", 22''' extend further into the partition 17, i.e. the notches end gradually.

While specific embodiments of the invention have been shown and described in detail to illustrate the application of the principles of the invention, it will be understood that the invention may be embodied otherwise without departing from such principles.

What is claimed is:

1. A fan, comprising:

a fan housing;

a gas intake channel having an opening cross section, and gas intake channel being connected to said fan housing;

a discharge channel having an opening cross section, said gas discharge channel being connected to said housing, said fan housing having a partition separating an intake channel opening of said gas intake channel from a discharge channel opening of said discharge channel;

gas propulsion means including a side channel fan;

gas flow interference means for inducing flow turbulence at least in the region of the opening cross-section of one of the gas intake channel and the gas discharge channel, said gas flow interference means including a plurality of interference elements, at least one of said interference elements being of a size which is different from a size of another of said interference elements, said plurality of interference elements including a first interference element positioned adjacent to a second interference element, said first interference element being spaced from said second interference element by a distance, an additional interference element being provided spaced a distance from said second interference element, said distance between said second interference element and said additional interference element being different from said distance between said first interference element and said second interference element.

2. A device according to claim 1, wherein said interference means is disposed at least in a marginal portion adjacent the gas intake channel.

3. A device according to claim 2, wherein said interference means is formed of a plurality of interference elements of a larger extension in a direction of fan rotation than in a direction perpendicular thereto.

4. A device according to claim 1, wherein said interference elements are formed by material recess notches of V-shaped cross-section.

5. A fan, comprising:

a fan housing;

a gas intake channel having an opening cross section, and gas intake channel being connected to said fan housing;

a discharge channel having an opening cross section, said gas discharge channel being connected to said housing, said fan housing having a partition separating an intake channel opening of said gas intake channel from a discharge opening of said discharge channel;

gas propulsion means including a side channel fan;

gas flow interference means for inducing flow turbulence at least in the region of the opening cross-section of one of the gas intake channel and the gas discharge channel, said gas flow interference means including a plurality of interference elements including a first interference element positioned adjacent to a second interference element, said first interference element being spaced from said second interference element by a distance, an additional interference element being provided spaced a distance from said second interference element, said distance between said second interference element and said additional interference element being different from said distance between said first interference element and said second interference element.

6. A fan, comprising:

a fan housing;

a gas intake channel having an opening cross section, and gas intake channel being connected to said fan housing;

a discharge channel having an opening cross section, said gas discharge channel being connected to said housing, said fan housing having a partition separating an intake channel opening of said gas intake channel from a discharge channel opening of said discharge channel;

gas propulsion means including a side channel fan;

gas flow interference means for inducing flow turbulence at least in the region of the opening cross-section of one of the gas intake channel and the gas discharge channel, said gas flow interference means including a plurality of interference elements, at least one of said interference elements being of a size which is different from a size of another of said interference elements.

7. A fan, comprising:

a fan housing;

a gas intake channel having an opening cross section, and gas intake channel being connected to said fan housing;

a discharge channel having an opening cross section, said gas discharge channel being connected to said housing, said fan housing having a partition separating an intake channel opening of said gas intake channel from a discharge channel opening of said discharge channel;

gas propulsion means including a side channel fan;

gas flow interference means for inducing flow turbulence at least in the region of the opening cross-section of one of the gas intake channel and the gas discharge channel, said gas flow interference means including a plurality of interference elements, at least one of said interference elements being of a shape which is different from a shape of another of said interference elements.

* * * * *